US010036610B2

(12) United States Patent
Rivera

(10) Patent No.: US 10,036,610 B2
(45) Date of Patent: Jul. 31, 2018

(54) WEAPONIZED DEFENSIVE AX TOOL

(71) Applicant: John Rivera, Melbourne, FL (US)

(72) Inventor: John Rivera, Melbourne, FL (US)

( * ) Notice: Subject to any disclaimer, the term of this patent is extended or adjusted under 35 U.S.C. 154(b) by 0 days.

(21) Appl. No.: 15/437,023

(22) Filed: Feb. 20, 2017

(65) Prior Publication Data

US 2017/0241739 A1 Aug. 24, 2017

Related U.S. Application Data

(60) Provisional application No. 62/297,843, filed on Feb. 20, 2016.

(51) Int. Cl.

| | |
|---|---|
| ***F41C 27/16*** | (2006.01) |
| ***F41H 13/00*** | (2006.01) |
| ***F41H 9/10*** | (2006.01) |
| ***F41G 1/35*** | (2006.01) |

(52) U.S. Cl.

CPC ..... *F41C 27/16* (2013.01); *F41G 1/35* (2013.01); *F41H 9/10* (2013.01); *F41H 13/0018* (2013.01)

(58) Field of Classification Search

CPC ..... F41C 27/16; F41C 27/18; F41C 27/20; F41G 1/35; F41H 9/10; F41H 13/0018; F41H 13/0012; F41H 13/0031

USPC ..... 42/69.01, 1.08, 1.09, 1.11, 1.16, 52, 53, 42/106

See application file for complete search history.

(56) References Cited

U.S. PATENT DOCUMENTS

| | | | | | |
|---|---|---|---|---|---|
| 1,298,920 | A | * | 4/1919 | Farago | F41C 27/16 30/122 |
| 1,330,062 | A | * | 2/1920 | Dluzniewski | F41C 27/16 42/53 |
| 1,404,034 | A | * | 1/1922 | Kurczab | F41C 27/16 30/337 |
| 1,478,568 | A | * | 12/1923 | Kaperzenski | F41C 27/16 30/286 |
| 2,050,861 | A | * | 8/1936 | Rolston | F41H 9/10 42/1.08 |
| 2,805,507 | A | * | 9/1957 | Buquor | F41C 27/16 206/317 |
| 4,058,237 | A | | 11/1977 | Luke | |
| 4,061,249 | A | | 12/1977 | Smith | |
| 4,241,850 | A | | 12/1980 | Speer | |
| 4,550,861 | A | | 11/1985 | Fay, Sr. | |
| 5,217,143 | A | | 6/1993 | Aitken | |
| 5,358,144 | A | | 10/1994 | Mock | |
| 5,516,005 | A | | 5/1996 | Moseley | |
| 5,815,467 | A | | 9/1998 | Deering | |
| 5,924,601 | A | | 7/1999 | Chen | |
| 6,135,321 | A | | 10/2000 | Hippensteel | |

(Continued)

*Primary Examiner* — John Cooper

(74) *Attorney, Agent, or Firm* — Beusse Wolter Sanks & Maire; John L. DeAngelis

(57) ABSTRACT

A tool. A firearm, a blade and an ancillary device are disposed within or on the tool. The firearm comprises a barrel through which a bullet passes to exit the firearm, a firing pin moveable to a firing position by operation of a firing pin control, a firing pin lock retaining the firing pin in the firing position when in the locked position, a biasing member for applying a force to the firing pin with the firing pin restrained against the force by the locked position of the firing pin lock. A trigger releases the firing pin lock from the locked position, such that the force causes the firing pin to strike the charge proximate the bullet. The bullet then exits the barrel.

2 Claims, 15 Drawing Sheets

(56) References Cited

U.S. PATENT DOCUMENTS

| | | | | |
|---|---|---|---|---|
| 6,540,106 | B2 | 4/2003 | Gerstner | |
| 6,540,107 | B1 | 4/2003 | Admony | |
| D530,386 | S * | 10/2006 | Betts | F41C 27/16 D22/101 |
| 8,196,328 | B2 * | 6/2012 | Simpkins | B25F 1/04 42/114 |
| 9,347,749 | B2 | 5/2016 | Olah | |

* cited by examiner

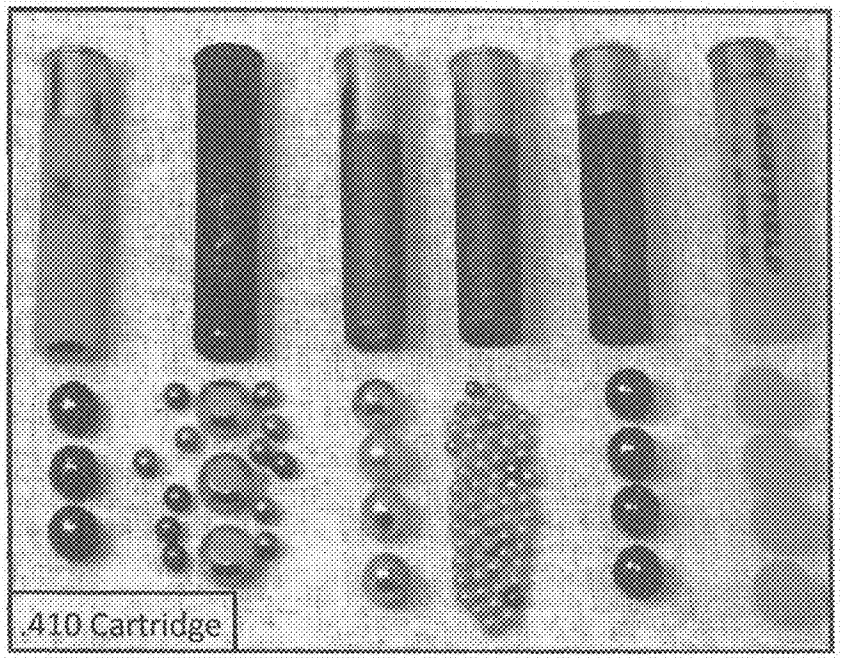
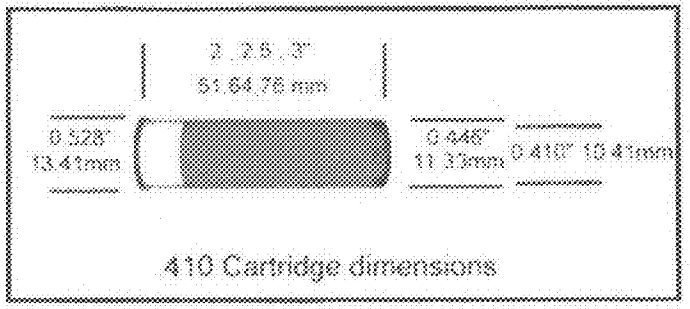
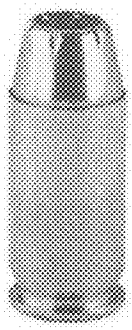
45 Caliber Bullet
FIGURE 10

WEAPONIZED DEFENSIVE AX TOOL

CROSS REFERENCE TO RELATED APPLICATIONS

This patent application claims the benefit of U.S. provisional patent application filed on Feb. 20, 2016 and assigned Application No. 62/297,843, which is incorporated herein in its entirety.

FIELD OF THE INVENTION

The present invention relates generally to a defensive weapon, and more particularly to a weaponized defensive ax tool.

BACKGROUND OF THE INVENTION

Many people spend time in the great outdoors; woods, forests, jungles, mountains, and the like. Often those venues are in remote locations inhabited by an assortment of potentially dangerous wildlife—snakes, bears, large cats, wild boars, alligators, not to mention potentially rabid smaller animal. As well, people who venture into those areas often seek to lighten the amount of gear that they carry: and in other instances, a fall or other mishap may separate them from a well-equipped back pack or other form of carrying or stowage—type satchel.

For that reason, a multi-purpose, light weight, back-up utility device, which allows for activities like chopping away branches or brush, or creating firewood, while at the same time, combining an assortment of varied weapons to be selected depending on the nature or degree of a perceived threat may prove a welcome addition to their foray into those environments.

BRIEF DESCRIPTION OF THE FIGURES

The skilled artisan will understand that the drawings, as described below, are for illustration purposes only. The drawings are not intended to limit the scope of the present invention in any way. Several of the Figures are block diagrams that depict the components necessary for the operation of the invention.

FIG. 10 illustrates the various bullets that can be used with the tool of the present invention.

FIGS. 18A and 18B are side views of embodiments of the tool incorporating external tool compartments and 19A and 19B are side views of embodiments of the tool incorporating firearm compartments.

DETAILED DESCRIPTION OF THE INVENTION

Before describing in detail the particular methods and apparatuses related to a multi-purpose weapon and tool, it should be observed that the present invention resides primarily in a novel and non-obvious combination of elements and process steps. So as not to obscure the disclosure with details that will be readily apparent to those skilled in the art, certain conventional elements and steps have been presented with lesser detail, while the drawings and the specification describe in greater detail other elements and steps pertinent to understanding the inventions.

The presented embodiments are not intended to define limits as to the structures, elements or methods of the inventions, but only to provide exemplary constructions. The embodiments are permissive rather than mandatory and illustrative rather than exhaustive.

The present invention addresses the circumstances described above in the BACKGROUND section by allowing the user to be prepared for an array of sudden or unanticipated events and enhances the user's chances of survival, or avoidance of harm or death.

The present invention flows from the use of a basic ax type structure. The entire ax structure has been re-engineered, expanded and adapted so that in one embodiment it provides a self-contained pepper spray-type deterrent, a Taser shocking device, a double-sided ax blade, and multi barreled firearm with a laser—guided aiming beam, as well as a flash light. The resulting tool or weapon is a non-obvious extension of a prior art ax.

Figure 1A:
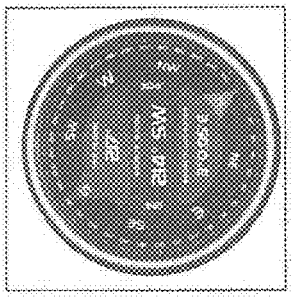
FIGS. 1A-1E illustrate various individual tools that have been engineered to work together and incorporated into an ax tool of the present invention.
Figure 1B:
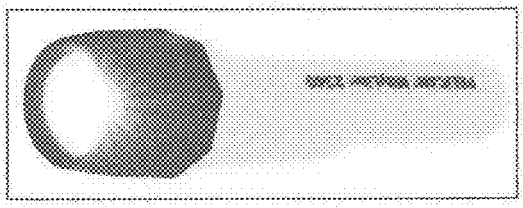
Figure 1C:
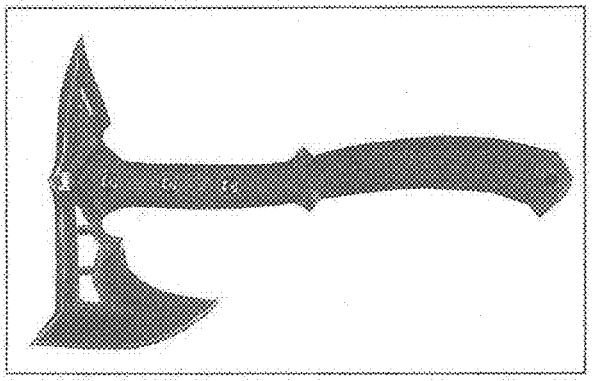
Figure 1D:
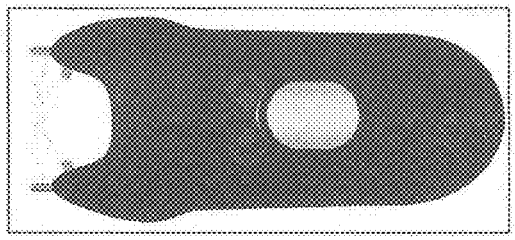
Figure 1E:
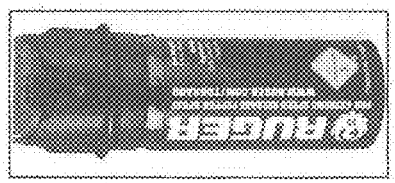

Yet another embodiment also includes a compass, a tool compartment, and hammering capability. Several of these components (referred to as ancillary devices) are depicted separately in FIG. 1A (pepper spray container), 1B (Taser), 1C (ax), 1D (light), and 1E (compass).

Figure 2:
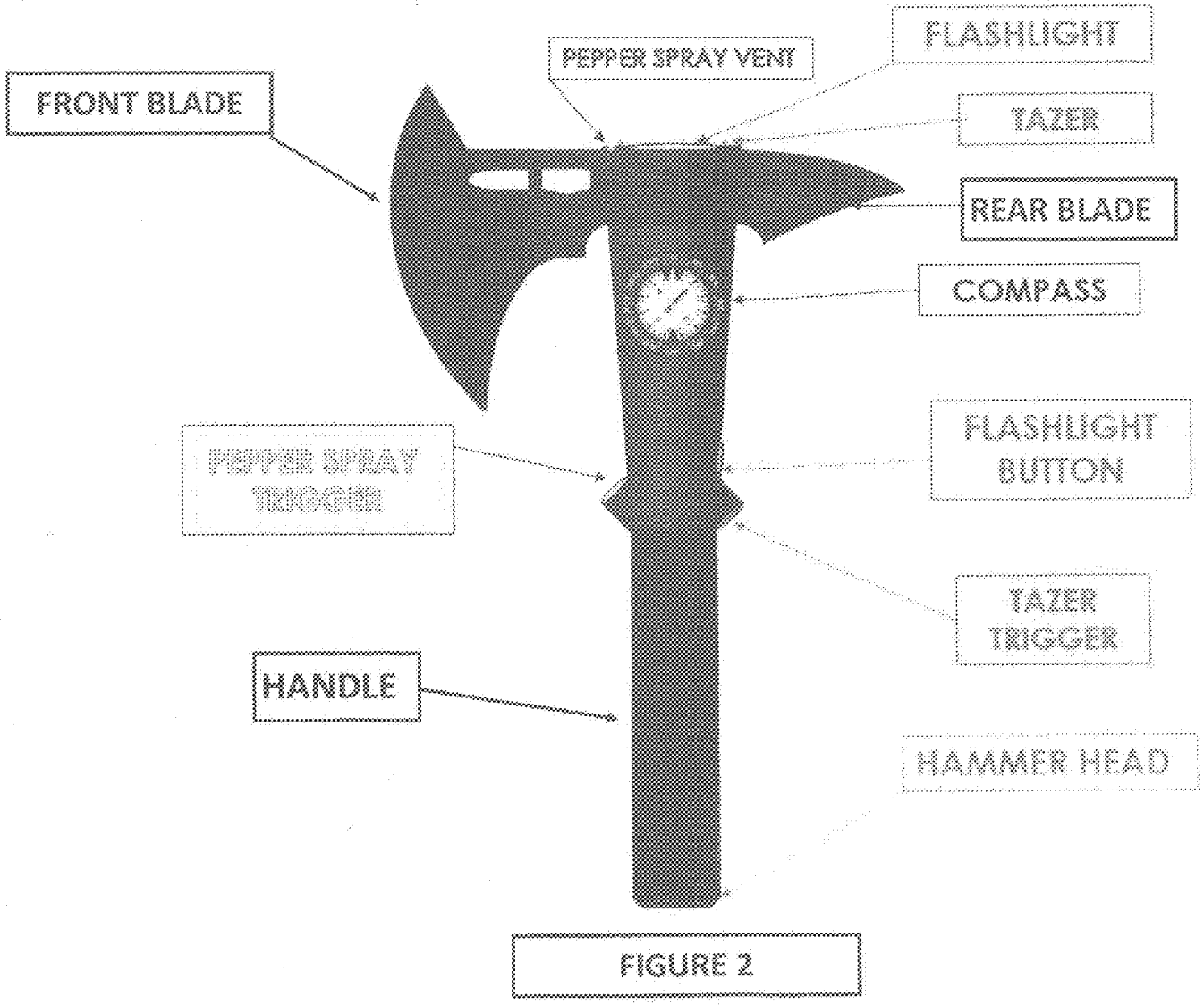
FIG. 2 illustrates a single sided view identifying the outside component parts of the weaponized ax tool.

FIG. 2 illustrates one embodiment of a tool or ax and its attached or embedded components. Accordingly, to this embodiment, the ax comprises a double-sided ax blade and a compass on one surface and a tool compartment on an opposing surface (not visible in FIG. 2). A butt end of the ax handle serves as a hammer head and thus can be used as a hammering tool. A pepper spray trigger, along the ax handle, ejects pepper spray from a pepper spray vent located at the ax-end (top) of the handle. Taser prongs, also located at the ax-end (top), are energized by depressing a Taser trigger located along the ax handle on the opposite side of the pepper spray trigger. A flashlight beam is activated by depressing the flashlight button. The various buttons are disposed along the handle at convenient locations within easy reach when the user grasps the ax handle.

Figure 3:
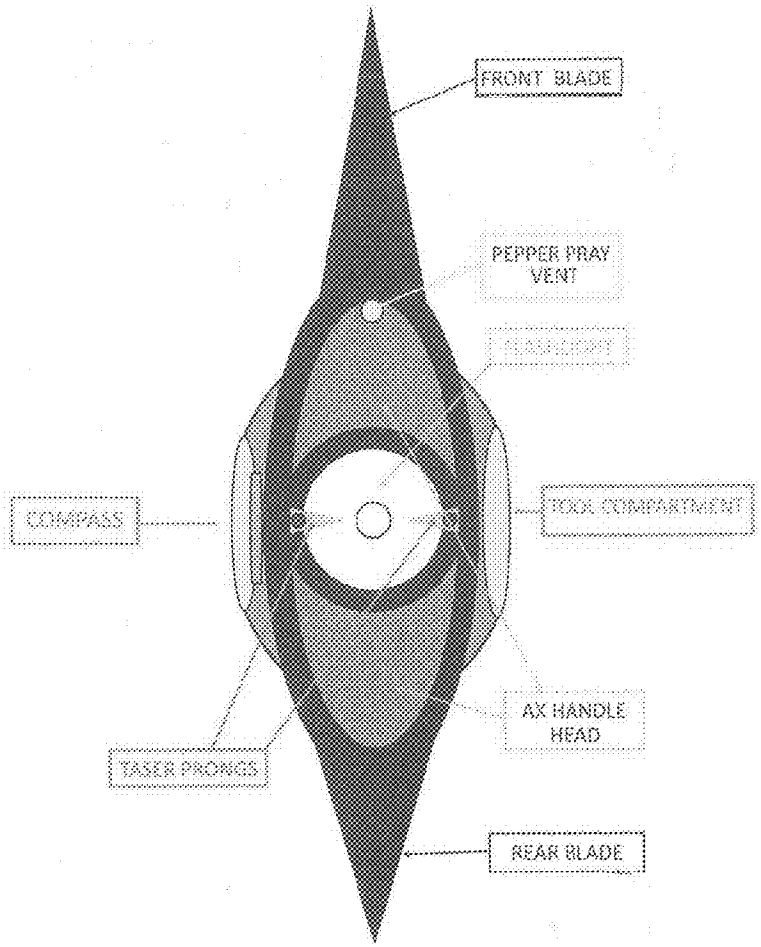
FIGS. 3 and 4 are respective top and side views of a tool constructed according to the teachings of the present invention.

FIG. 3 is a top view of the ax tool head showing the location of the Taser prongs, the source of the flashlight beam and pepper spray vent. A location of a tool compartment is also indicated generally.

Figure 4:
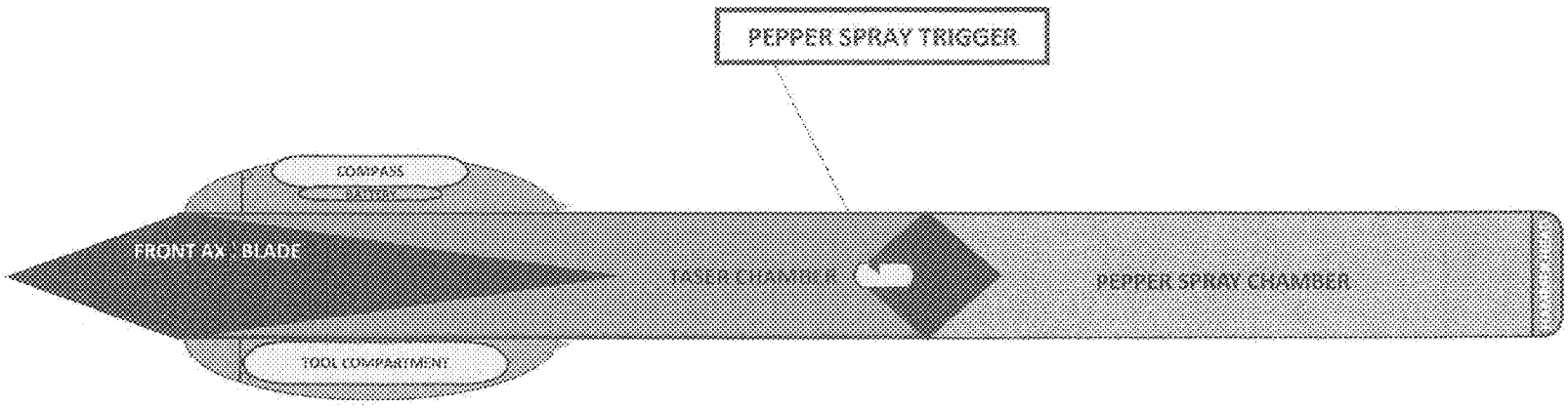

FIG. 4 is a side view of the ax tool, showing in particular, the pepper spray trigger and the pepper spray chamber.

One embodiment of the ax includes a firearm component that stores and can fire up to two 45 caliber bullets, shotgun shells as well as other calibers of ammunition.

Figure 5:
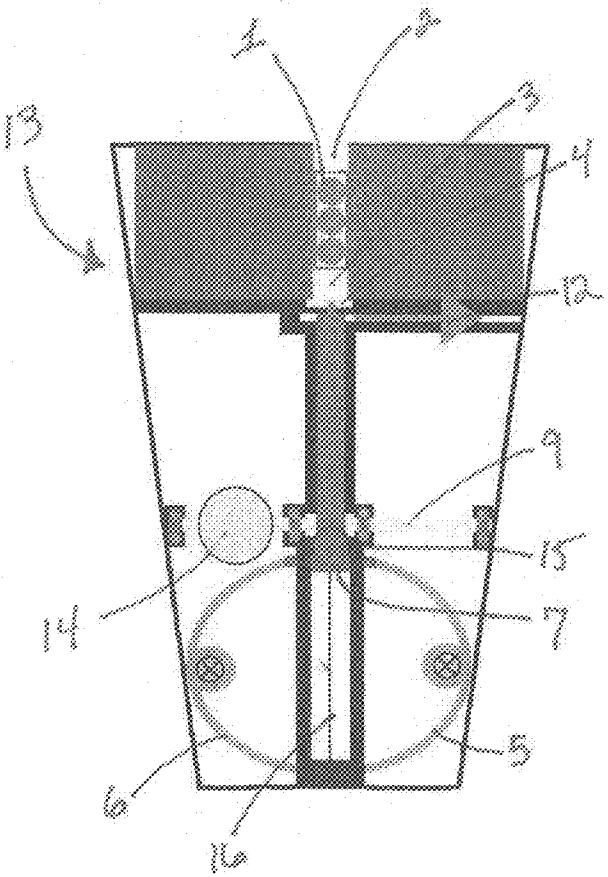
FIG. 5 is a cut-away top view of the internal firearm component of the tool.

The firearm compartment shown in a cut-away top view of FIG. 5, is illustrated generally and in more detail in FIGS. 6 through 9.

Figure 8:
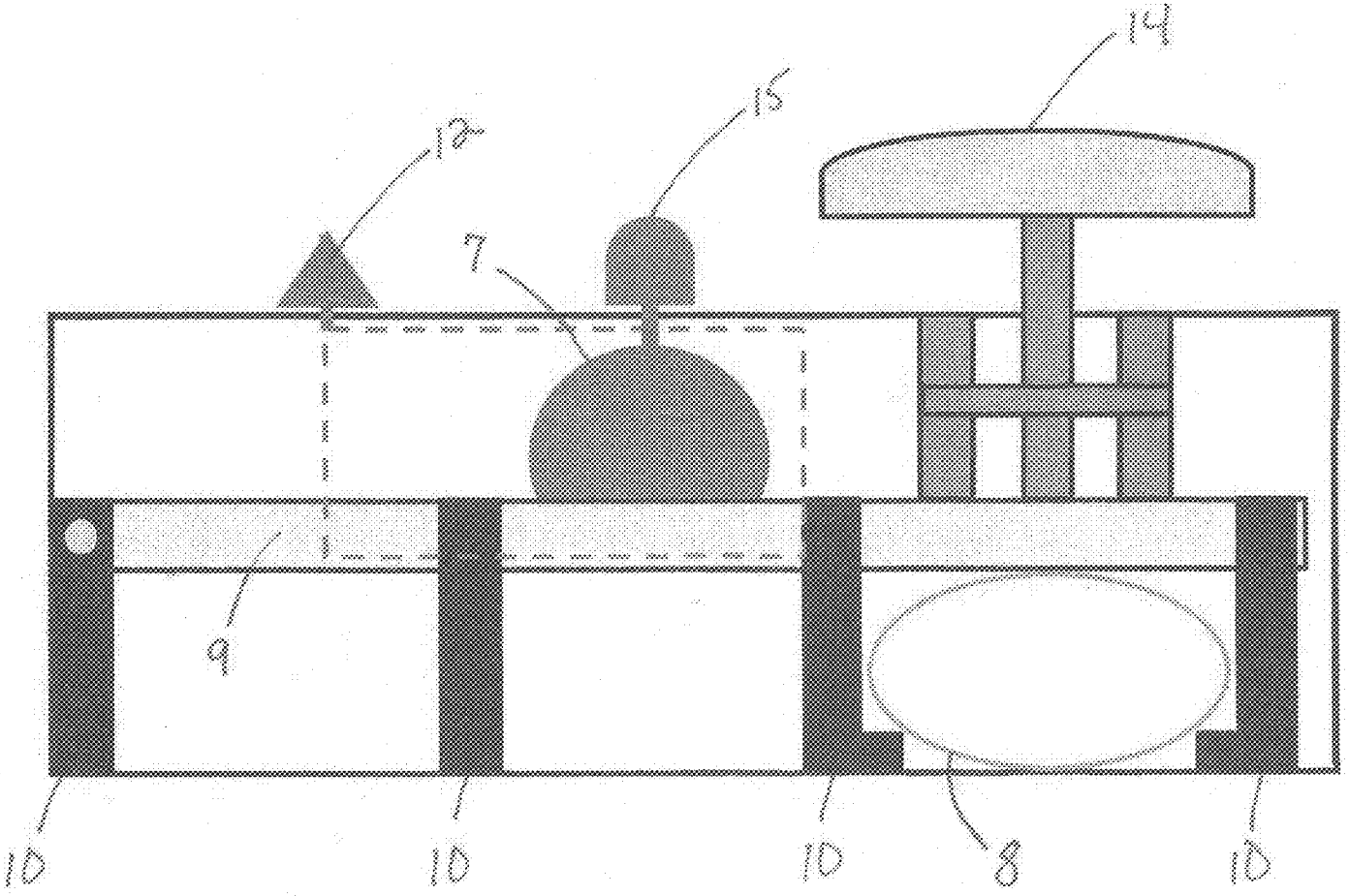
FIGS. 8 and 9 are cut-away views of the internal components of the firearm component.
Figure 9:
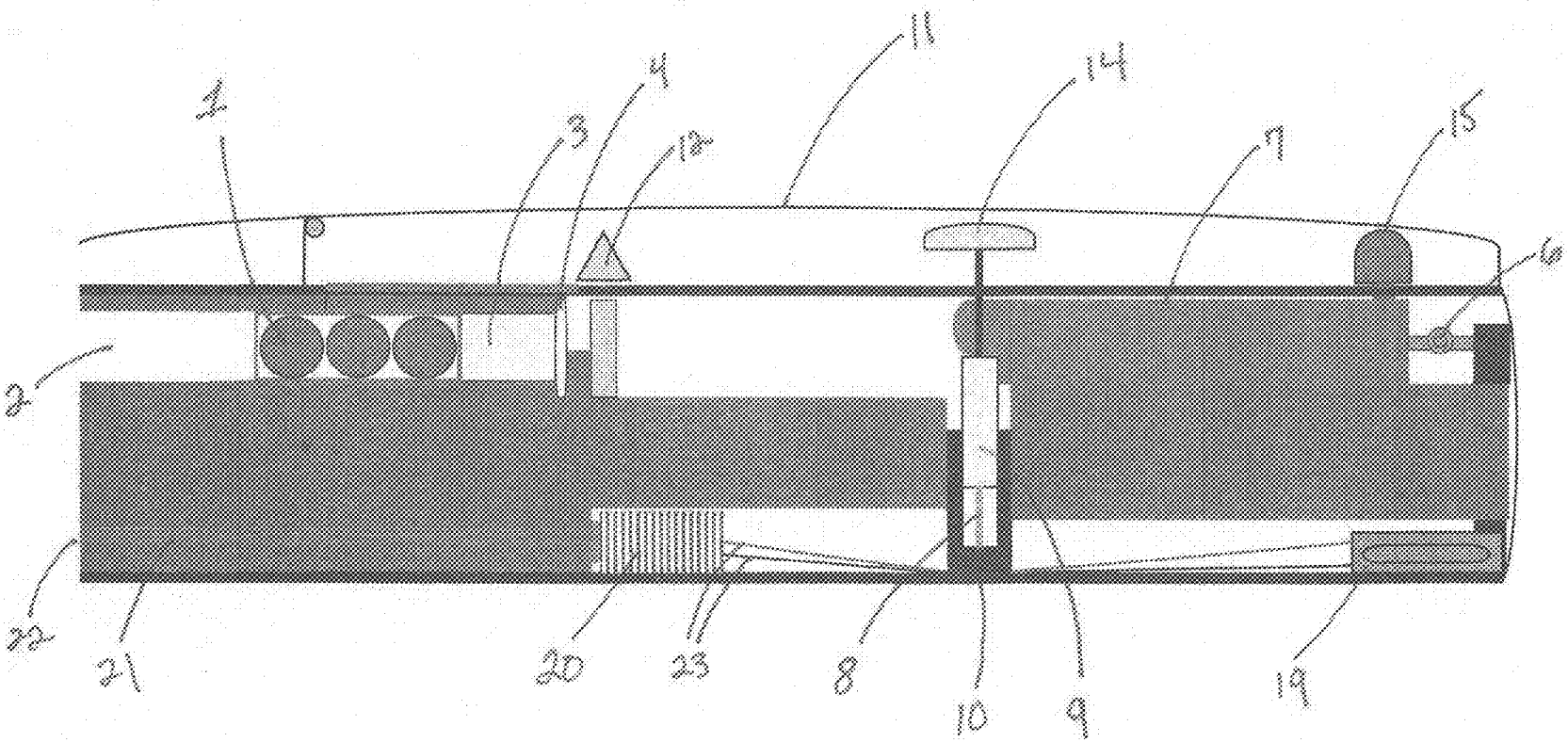

Referring to the FIG. 5 cut-away top view, the FIG. 8 cut-away front view and the FIG. 9 cut-away side view, the weapon components are depicted in greater detail.

Turning to FIG. 5, the firearm component, when fired by a user, ejects a bullet 1 from a barrel 2. The bullet 1 is encased within a shell 3. The rear surface of the shell 3 comprises a charge (primer) 4. In a "ready to fire" condition, the firearm coils 5 and 6 are in a biased or cocked condition, applying a force to the rear surface of the firing pin 7.

Turning to FIG. 8, a spring or coil 8 urges a firing pin lock bar 9 upwardly within a u-shaped support member 10 to retain the firing pin 7 in the "ready to fire" configuration against the force exerted on the firing pin 7 by the coils 5 and 6 illustrated in FIG. 5. The coils 5 and 6 generate sufficient force to drive the firing pin 7 forward to strike the charge 4 to eject the bullet 1 from the barrel 2.

Depressing the trigger 14 releases the firing pin 7 (see in particular FIG. 9), driving the firing pin forward to strike the charge 4 to eject the bullet 1 from the barrel 2. The features and functionality of the firing pin safety handle 12, which must be positioned to expose the charge 4, is described below.

FIG. 9 depicts the cut-away side view of the various components of the firearm component including: the bullet 1, the barrel 2, the shell 3, the primer (charge) 4, the safety cover 11, the trigger 14, the firing pin 7, the firing pin slide 15, the firing pin lock bar 9, the firing pin coil 6, the firing pin lock bar coil 8, the U-shaped support member 10.

One embodiment of the invention further comprises a laser 20, powered by a battery 19. A laser beam 21 is emitted through an opening 22 in the body of the firearm component 13 as depicted in FIG. 5.

The user's use of the laser beam provides more accurate aiming at a target. Conductors 23 supply power from the battery 19 to the laser 20. In one embodiment, the laser turns on when the user opens the safety cover 11 of FIG. 9.

To place the firearm component 13 in a firing-ready condition a firing pin slider 15 is moved within a respective groove 16 in a direction away from the barrel 2. This action biases the coils 5 and 6 and causes the spring or coil 8 to force the firing pin lock bar 9 upwardly to lock the firing pin 7 in the firing-ready condition. As best illustrated in FIGS. 8 and 9, the firing pin lock bar 9 prevents the firing pin 7 from moving forward until the trigger 14 is depressed.

Figure 7:
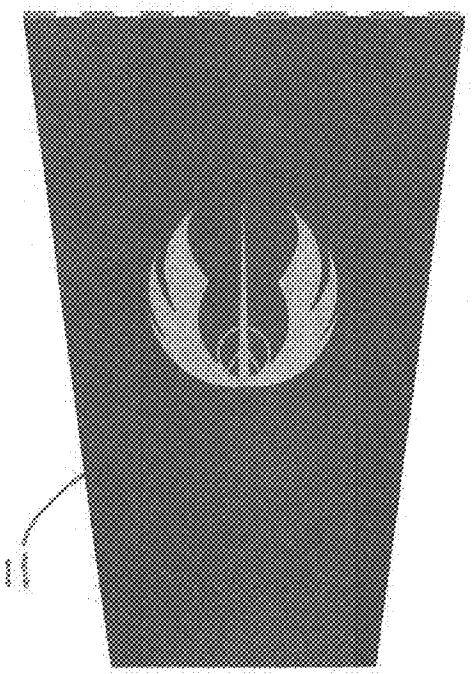
FIGS. 6 and 7 are views of the firearm operations platform and outer cover.
Figure 6:
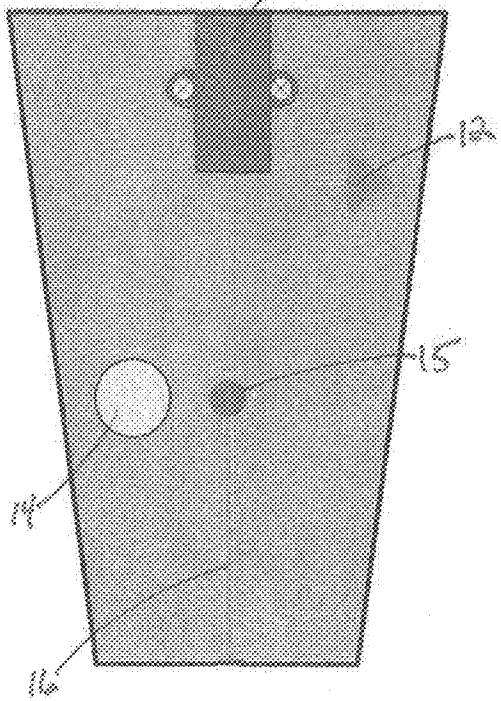

To fire the firearm, a safety cover 11 (FIG. 7) is lifted revealing the operational components; see FIG. 6. The trigger 14, the primer safety handle 12, the firing pin slider 15 and its groove 16, and the bullet loading zone cover 17 are shown in FIG. 7.

To provide additional protection against an accidental firing, the primer safety handle 12 (see FIG. 9) is typically maintained in position against and covering the charge 4. Applying a force against the primer safety handle 12 causes the handle to move toward an edge of the weapon 13 as depicted in FIG. 5. This action exposes the primer charge 4.

Then depressing the trigger 14 lowers the firing pin lock bar 9 within the U-shaped support member 10 releasing the coils 5 and 6 from their biased condition, driving the firing pin 7 forward to strike the charge 4 and ejecting the bullets 1 from the barrel 2.

The firearm component is further described in the co-pending and co-owned patent application filed on Feb. 16, 2017 and assigned application Ser. No. 15/434,366. The contents of that application are incorporated herein by reference.

FIG. 10 depicts various types of the .410 shotgun shell ammunition. This device can also fire .45 colt ammunition, .45 Schofield ammunition. Any ammunition with a 13.41 mm primer and 11.33 mm shell casing can be loaded into the firearm component through the firearm loading zone cover 17. Those skilled in the art recognize that the firearm component 13 can be scaled up or down to accommodate differently sized ammunition.

Figure 11:
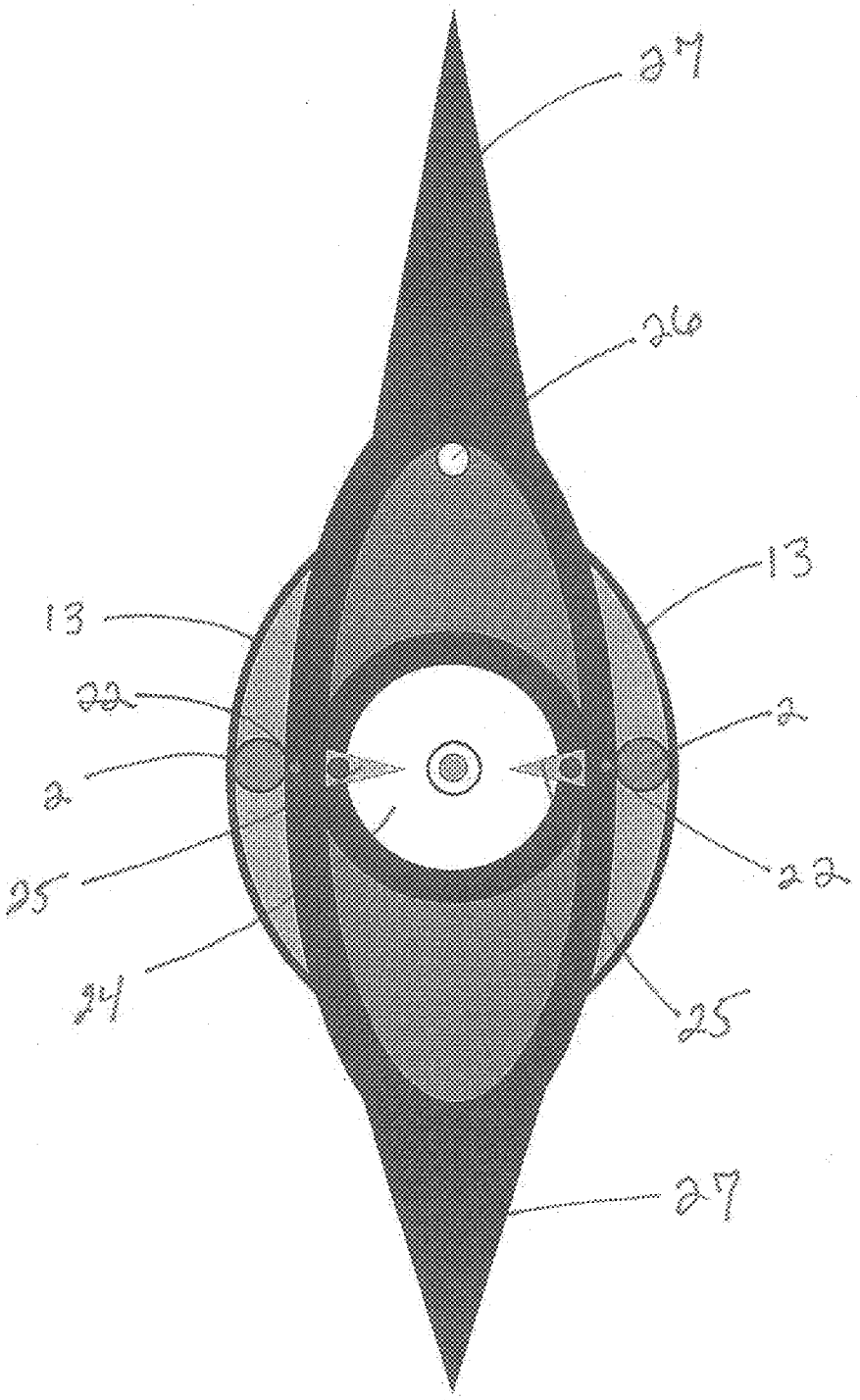
FIG. 11 is a top view of one embodiment of the tool of the present invention.

FIG. 11 depicts a top view of the ax handle head in the embodiment including the firearm component. The firearm components 13 are disposed on each side of the ax handle head, each with their own barrel 2 (a dual barrel configuration).

The flashlight 24, the Taser prongs 25, the pepper spray vent 26, the ax's blades 27 and the laser beam opening 22 are also depicted in FIG. 11.

Figure 12:
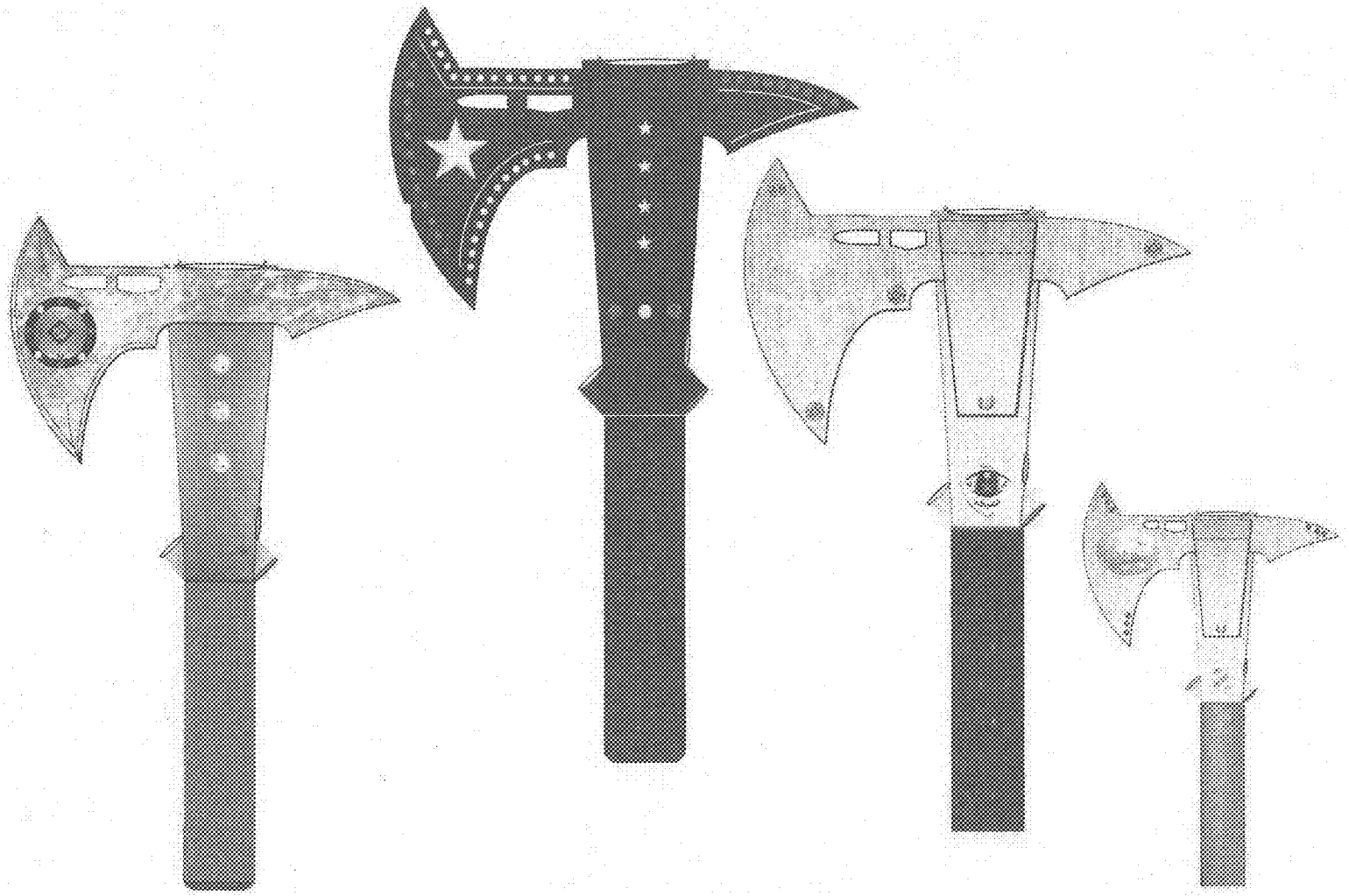
FIG. 12 illustrates various embellished ax heads of the tool of the present invention.

FIG. 12 illustrates the various ornamental designs for the ax tool of the present invention. The various metals used in the construction of the ax structure can comprise, for example: gold, titanium of varied colors, steel, brass, copper, platinum, silver, aluminum, and pewter; the jewels, for example, sapphires, rubies, emeralds, diamonds; and handle grip material types, such as various embossed leathers.

Figure 14:
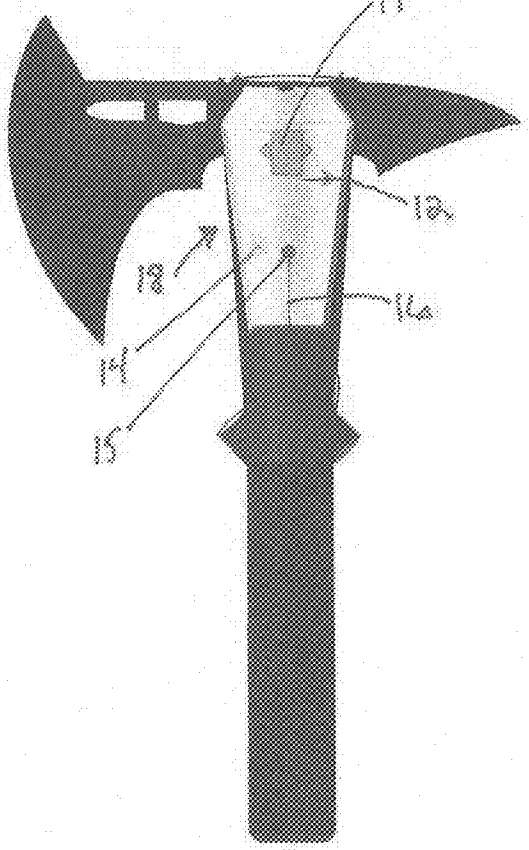
FIGS. 13 and 14 illustrate components associated with the firearm of the present invention.
Figure 13:
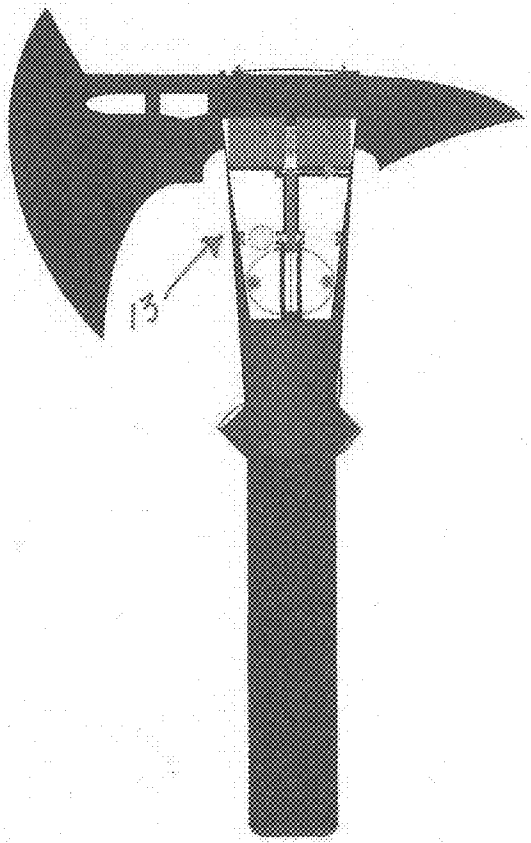

FIG. 13 depicts the ax structure, especially the firearm components, as described above, of the firearm component 13. A platform on which the operational components are disposed 18 is depicted in FIG. 14 showing the firing pin slider 15 and its respective groove 16, the primer safety handle 12, the trigger button 14 and the bullet loading zone cover 17. The bullet loading zone cover when removed or lifted opens up a compartment where the bullet is loaded into the barrel 2.

Figure 15:
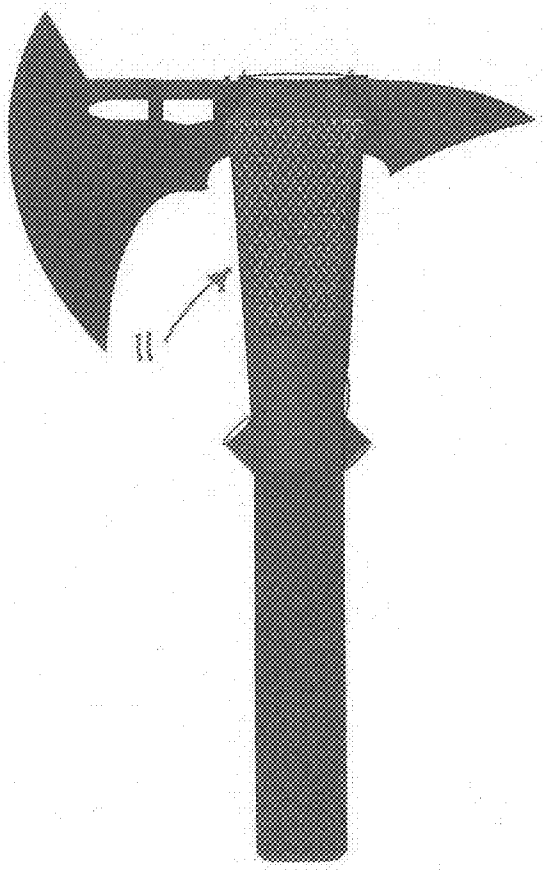
FIG. 15 illustrates a side view of the tool of the present invention.

FIG. 15 depicts the firearm component safety cover 11 in its closed position blocking the operational components of the firearm from view.

Figure 16:
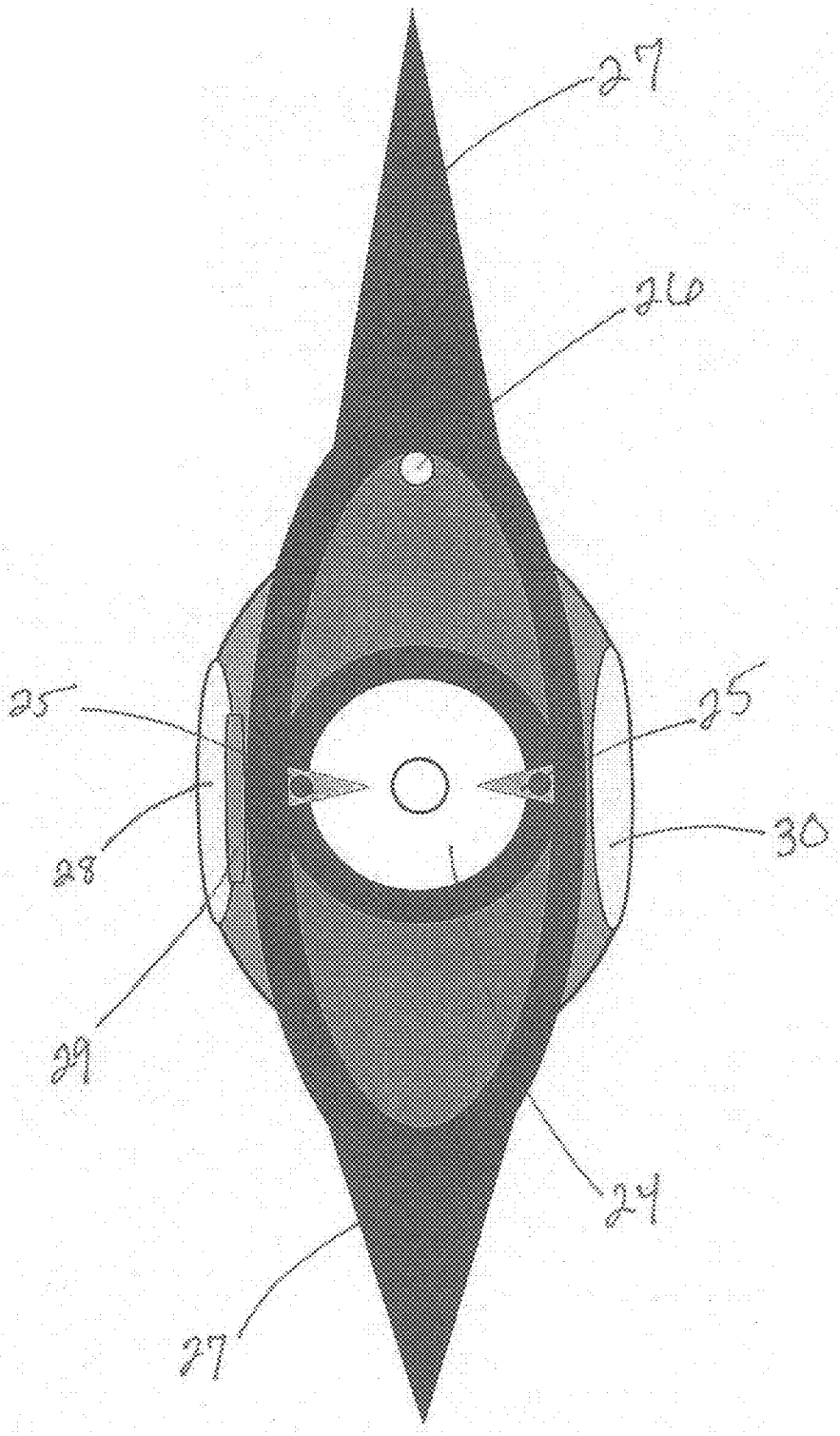
FIG. 16 is a top view and FIG. 17 an internal side view of one embodiment of the tool of the present invention.

FIG. 16 depicts the top view of another embodiment the ax handle tool. This embodiment includes the compass 28, the compass battery compartment 29, the flashlight 24, the Taser prongs 25, the pepper spray vent 26, the ax blades 27 and the tool compartment 30. The compass 28 is always available for view on one side of the ax handle.

The tool compartment is covered by a safety cover 11, as depicted in FIG. 15. The tool compartment is designed to carry micro tools or a micro tool assembly of the user's choice.

Figure 17:
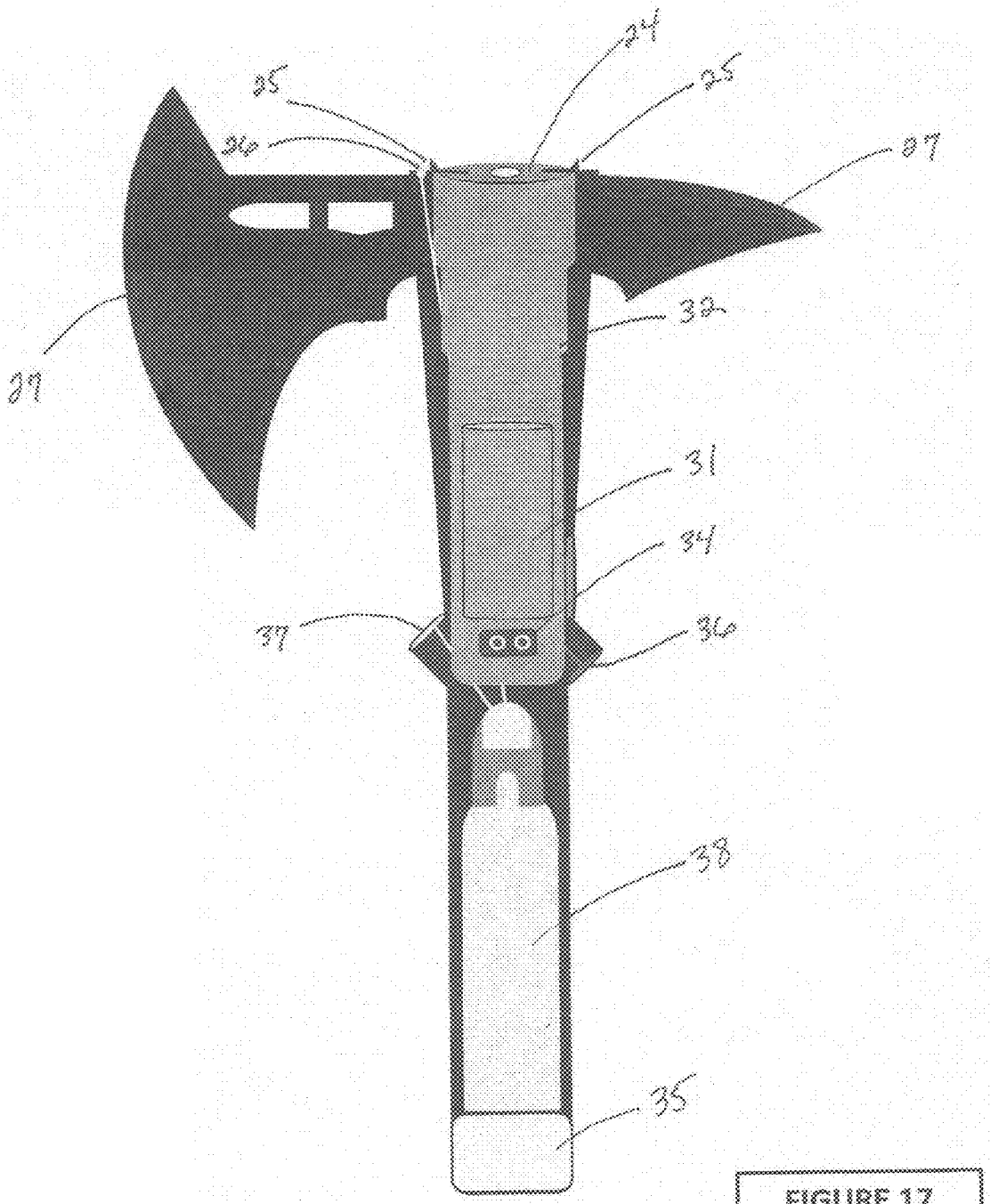
Figures 16A, 16B:
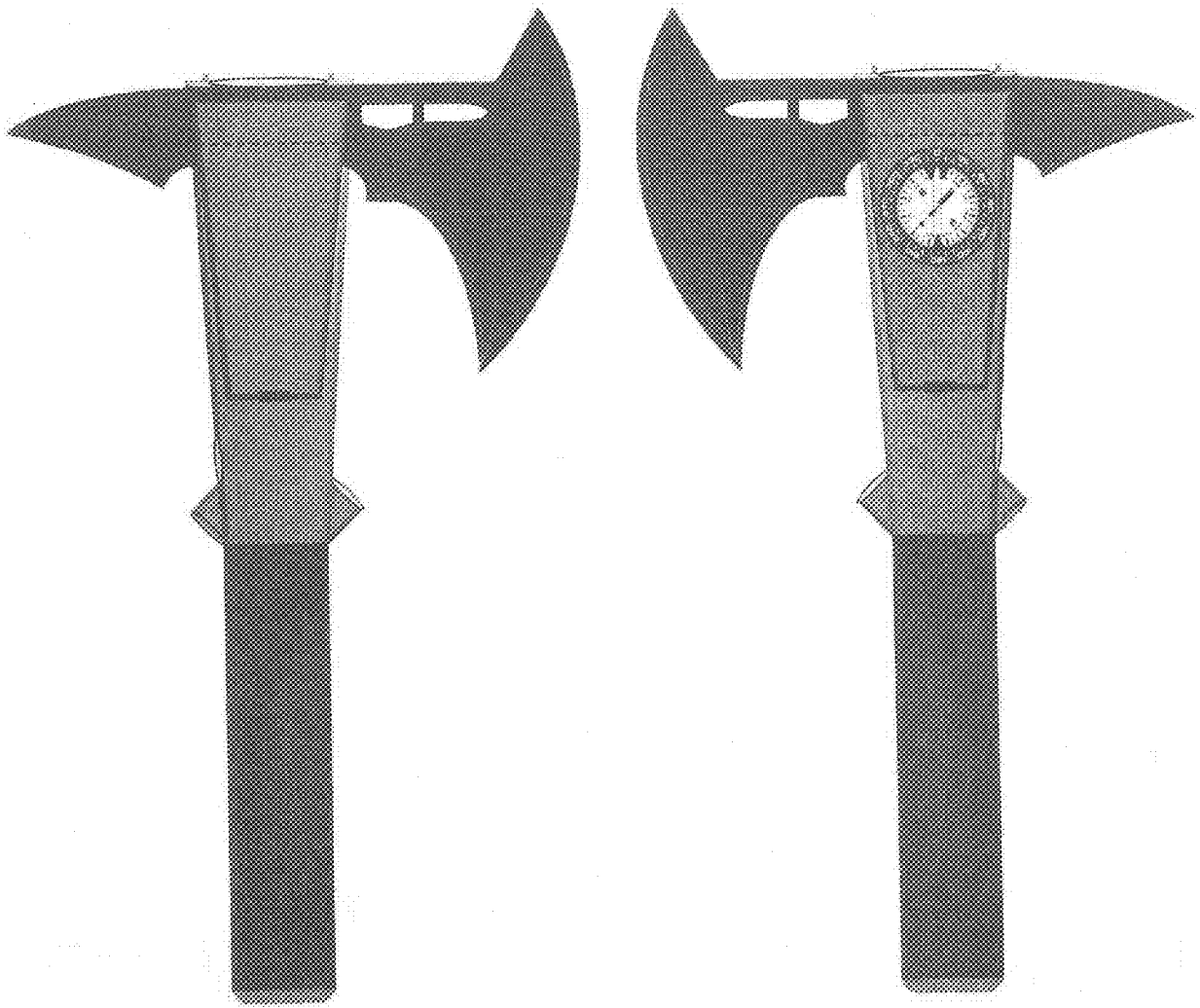

FIG. 17 depicts internal components of the ax structure as related to the Taser component 32 and its associated components, i.e., a battery 31 for supplying power to the Taser and a receptacle 34 for connection to a power source for charging the battery 31.

The pepper spray component 38 is illustrated within the ax handle. The button 37 activates the pepper spray component 38. The pepper spray exits through the pepper spray vent 26.

The hammer head 35 is attached after the tube of pepper spray 38 is installed. The hammer head can be used to hammer nails and/or to crush small aggregate.

Figures 19A, 19B:
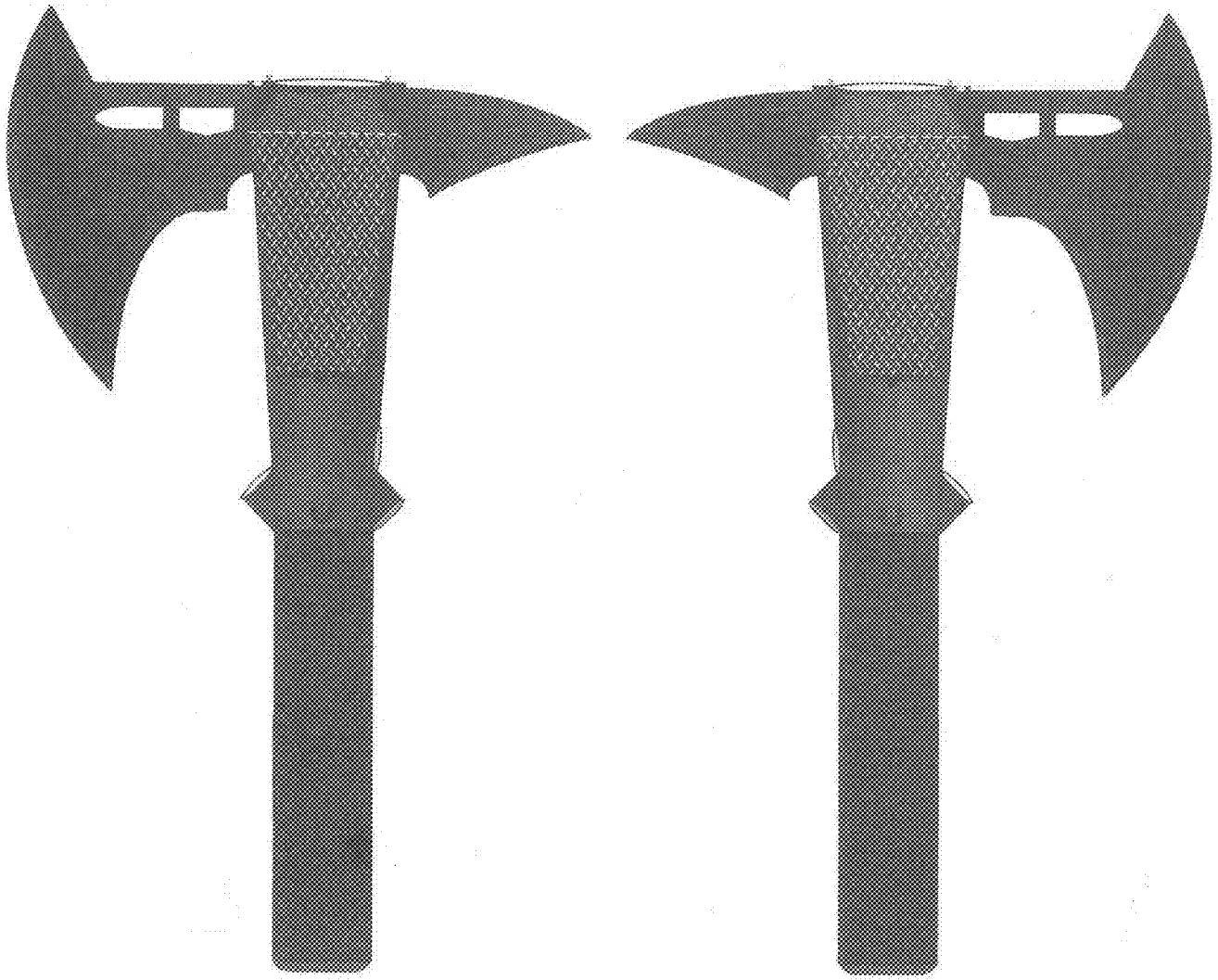

FIGS. 18A and 18B depict two opposing sides of one embodiment of the ax tool. FIGS. 19A and 19B depict two opposing sides or another embodiment of the ax tool.

Although the invention has been shown and described with respect to a certain preferred embodiment or embodiments, equivalent alterations and modifications may occur to others skilled in the art upon the reading and understanding of this specification and the annexed drawings. In particular regard to the various functions performed by the above described components (assemblies, devices, circuits, etc.), the terms used to describe such components are intended to correspond, unless otherwise indicated, to any component that performs the specified function of the described component (i.e., that is functionally equivalent), even though not structurally equivalent to the disclosed structure, which performs the function in the herein illustrated exemplary embodiments of the invention. In addition, while a particular feature of the invention may have been disclosed with respect to only one of several embodiments, such feature may be combined with one or more other features of the other embodiments as may be desired and advantageous for any given or particular application.

What is claimed is:

1. An ax comprising:

an ax handle;

first and second blades extending in opposing directions from a head end of the ax handle;

first and second firearms comprising respective first and second barrels disposed on opposing surfaces of the ax;

each of the first and second firearms further comprising:

a primer safety component disposed proximate a charge and moveable between a safety position and a firing position, ignition of the charge when the primer safety component is in the firing position causing a bullet to be ejected from the barrel;

a primer safety handle for controlling the primer safety component between the safety position and the firing position;

a firing pin moveable to a firing position by operation of a firing pin control;

a firing pin lock retaining the firing pin in the firing position when in a locked position;

a biasing member for applying a force to the firing pin, the firing pin restrained against the force by the locked position of the firing pin lock;

a trigger for releasing the firing pin lock from the locked position such that when the primer safety component is in the firing position, the force causes the firing pin to strike the charge, thereby causing the bullet to be ejected from the barrel; and an ancillary device for performing a work task, the ancillary device comprising one or more of a of a pepper spray instrument, a Tazer, a light, and a compass.

2. The ax of claim 1 wherein the first and second barrels are disposed on.

* * * * *